US011647874B2

(12) United States Patent
Aparicio et al.

(10) Patent No.: US 11,647,874 B2
(45) Date of Patent: May 16, 2023

(54) RAISED TOILET SEAT AND METHOD FOR FITTING SAME

(71) Applicant: HERDEGEN, Chelles (FR)

(72) Inventors: Enrique Aparicio, Le Perreux-sur-Marne (FR); Vincent Herdegen, Gournay-sur-Marne (FR)

(73) Assignee: HERDEGEN, Chelles (FR)

( * ) Notice: Subject to any disclaimer, the term of this patent is extended or adjusted under 35 U.S.C. 154(b) by 146 days.

(21) Appl. No.: 17/179,398

(22) Filed: Feb. 18, 2021

(65) Prior Publication Data

US 2021/0259484 A1 Aug. 26, 2021

(30) Foreign Application Priority Data

Feb. 24, 2020 (FR) ..... 20 01804

(51) Int. Cl.
*A47K 13/00* (2006.01)
*A47K 13/26* (2006.01)

(52) U.S. Cl.
CPC ..... *A47K 13/005* (2013.01); *A47K 13/26* (2013.01)

(58) Field of Classification Search
CPC ..... A47K 13/005; A47K 13/28
USPC ..... 4/239
See application file for complete search history.

(56) References Cited

U.S. PATENT DOCUMENTS 2,104,714 A * 1/1938 Moore ..... A47K 13/28 4/240
3,341,867 A * 9/1967 Keen ..... A47K 13/28 4/239
5,873,625 A * 2/1999 Uchtman ..... A47C 7/66 297/184.15
6,018,825 A 2/2000 Enomoto

FOREIGN PATENT DOCUMENTS

GB 2334974 B * 3/2002 ..... A47K 13/005
KR 2004 0010901 2/2004
KR 2012 0081854 7/2012

OTHER PUBLICATIONS

International Search Report dated Nov. 2, 2020.

* cited by examiner

*Primary Examiner* — Christine J Scubinna
(74) *Attorney, Agent, or Firm* — IPSilon USA, LLP

(57) ABSTRACT

A raised toilet seat has a front part (2) and two wings (3, 4) of which the ends are, before the raised seat is fitted, separated by a gap. The wings (3, 4) at their free ends bear, in the case of one of them (3), a channel section equipped with notches (9, 10), and, in the case of the other (4), an opening (12) to accept the channel section, and ridges (13, 14, 15, 16) to retain the notches (9, 10).

5 Claims, 3 Drawing Sheets

RAISED TOILET SEAT AND METHOD FOR FITTING SAME

RELATED APPLICATION

This application claims the benefit of priority from French Patent Application No. 20 01804, filed on Feb. 24, 2020, the entirety of which is incorporated by reference.

FIELD OF THE INVENTION

The invention relates to a raised toilet seat and to the method of fitting same.

A raised toilet seat is generally made up of two injection-moulded plastic shells which are assembled, or of a plastic component obtained by rotational moulding.

DESCRIPTION OF THE PRIOR ART

Document KR 2012 0081854 describes a raised toilet seat comprising a front part and two wings of which the ends are separated by a gap, the wings at their free ends bearing, in the case of one of them, a channel section equipped with notches, and, in the case of the other, an opening to accept the channel section, and ridges to retain the notches.

In order to fix the raised seat on the toilet bowl it is known practice to use screws which press against the bowl from the outside. These screws, of which there are generally three, are placed on the front and the sides of the bowl. In another embodiment, the raised seat is equipped with fixing tabs, for example four of these, which are removable and which each comprise a tongue that is guided manually for fitting it.

All of these embodiments involve accessories which have to be manipulated in order to fit the raised seat and remove it for the purposes of cleaning it. In addition, the shape of the raised seat does not, in general, correspond exactly to the shape of the bowl, making the accessories all the more necessary, increasing the cost of the raised seat, and making it more complicated to fit, thereby increasing the risks of error and accident.

OBJECTS AND SUMMARY

One of the objects of the invention is to propose a raised seat that does not exhibit the aforementioned disadvantages and that allows for quick and easy fitting, and a certain stability on the bowl.

Another object of the invention is to propose a raised seat in which the constituent components are simplified and lower in number.

Another object of the invention is to propose a raised seat that is easy to remove and to clean, thus reducing bacteriological risks.

One subject of the invention is a raised toilet seat comprising a front part and two wings of which the ends are, before the raised seat is fitted, separated by a gap, the wings at their free ends bearing, in the case of one of them, a channel section equipped with notches, and, in the case of the other, an opening to accept the channel section, and ridges to retain the notches, characterized in that the channel section has a flat bottom and side walls that are parallel to one another and bear the notches on their exterior face and in the vicinity of their free end, and in that the channel section comprises, articulated to the free end of the flat bottom, a flap able to be lodged between the side walls in order to lock them in position parallel to one another.

According to one embodiment, the raised seat comprises a front lip and two lateral lips for pressing laterally on the front part and on the sides of the toilet bowl respectively.

According to one embodiment, the notches have a front face that is oblique to make it easier for them to pass over the ridges, and a rear face that is substantially perpendicular to the respective side wall so that they are retained by the ridges.

Another subject of the invention is a method for fitting the aforementioned raised seat, characterized by the steps of:

- pivoting the flap towards the outside of the channel section;
- inserting the channel section borne by one of the wings of the raised seat into the opening borne by the other wing of the raised seat as far as a visible mark;
- pivoting the flap towards the inside of the channel section to lock the side walls of the channel section in their relative position;
- placing the raised seat onto the toilet bowl with the front lip pressing against the front lateral part of the bowl;
- using manual pressure to bring the wings of the raised seat closer together, causing the channel section to progress further in the opening and causing the notches to move past the ridges until the lateral lips are pressing against the sides of the bowl.

A further subject of the invention is a method for removing the aforementioned raised seat, characterized by the steps of:

- removing the raised seat from the bowl by pulling vertically;
- turning the raised seat over;
- pivoting the flap towards the outside of the channel section;
- grasping the side walls of the channel section between the two wings of the raised seat and bringing them closer towards one another in order to cause the notches to escape from the ridges;
- allowing the elasticity of the raised seat to cause the ends of the wings to spring apart.

BRIEF DESCRIPTION OF THE DRAWINGS

The invention is described with reference to the attached drawings, in which.

DETAILED DESCRIPTION

Figure 1:
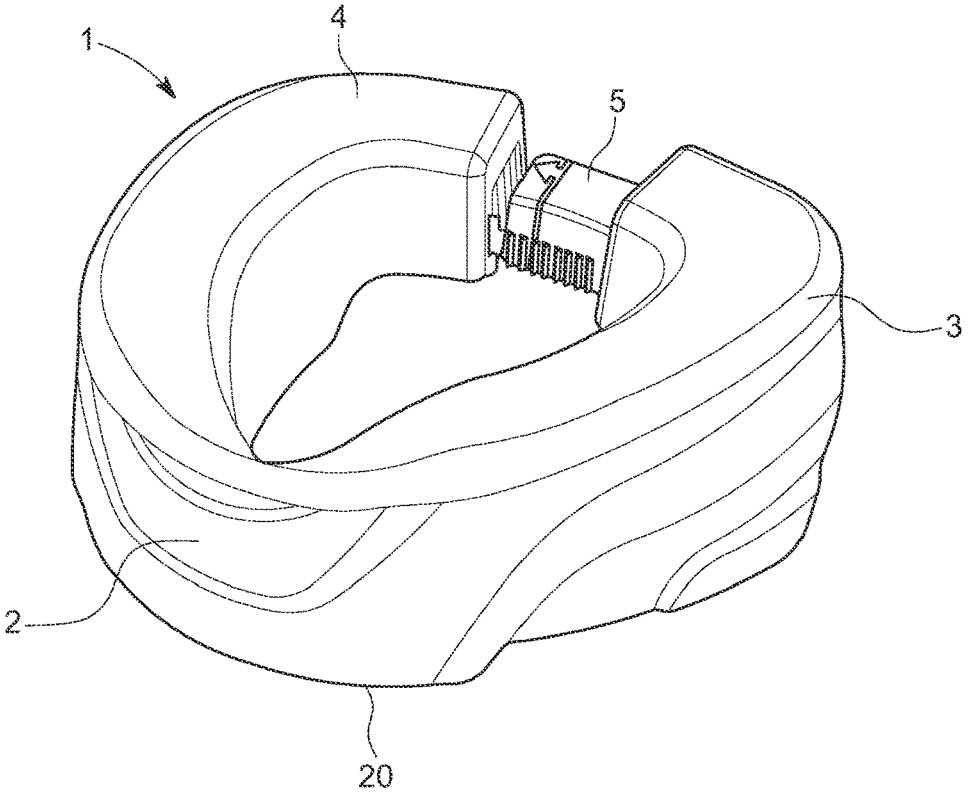
FIG. 1 depicts a perspective view of one embodiment of a raised seat according to the invention, prior to fitting.
Figure 2:
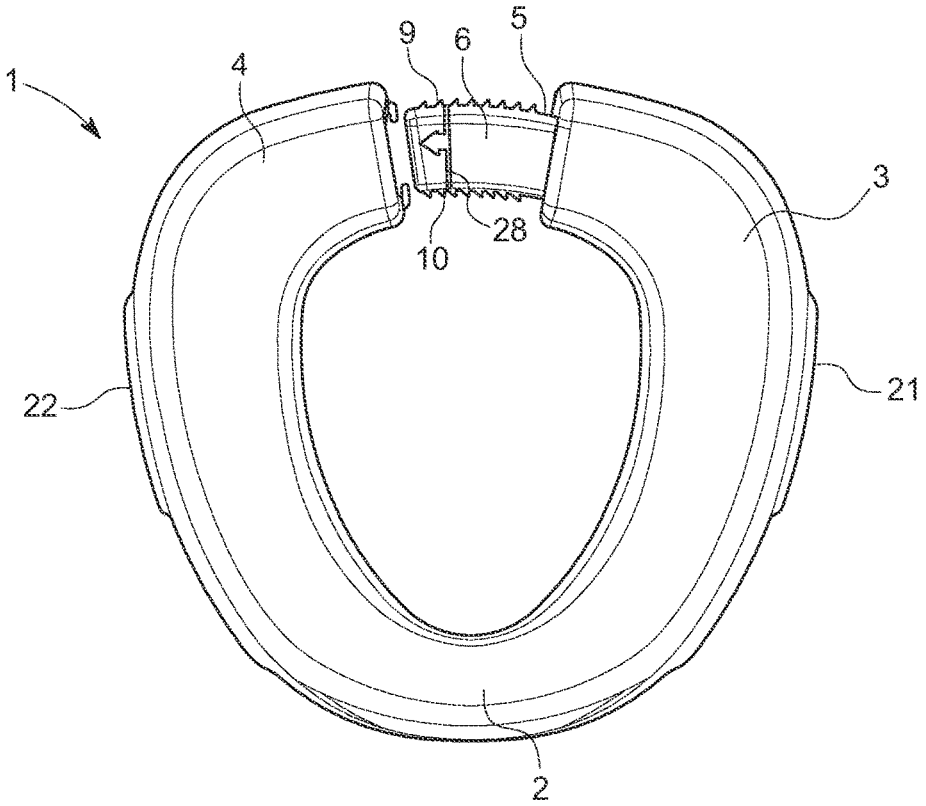
FIG. 2 depicts a view from above of one embodiment of a raised seat, according to the invention, prior to fitting.
Figure 3:
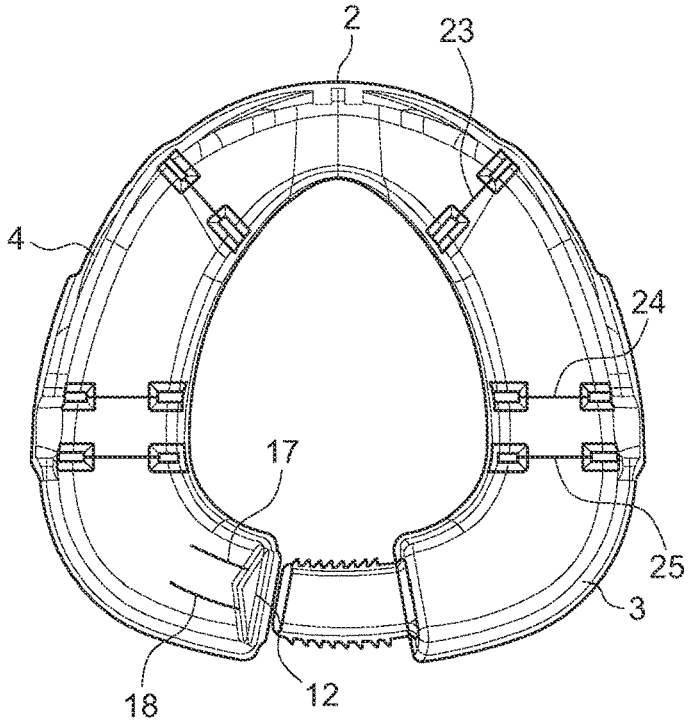
FIG. 3 depicts a view of the raised seat of FIG. 2, from beneath.
Figure 4:
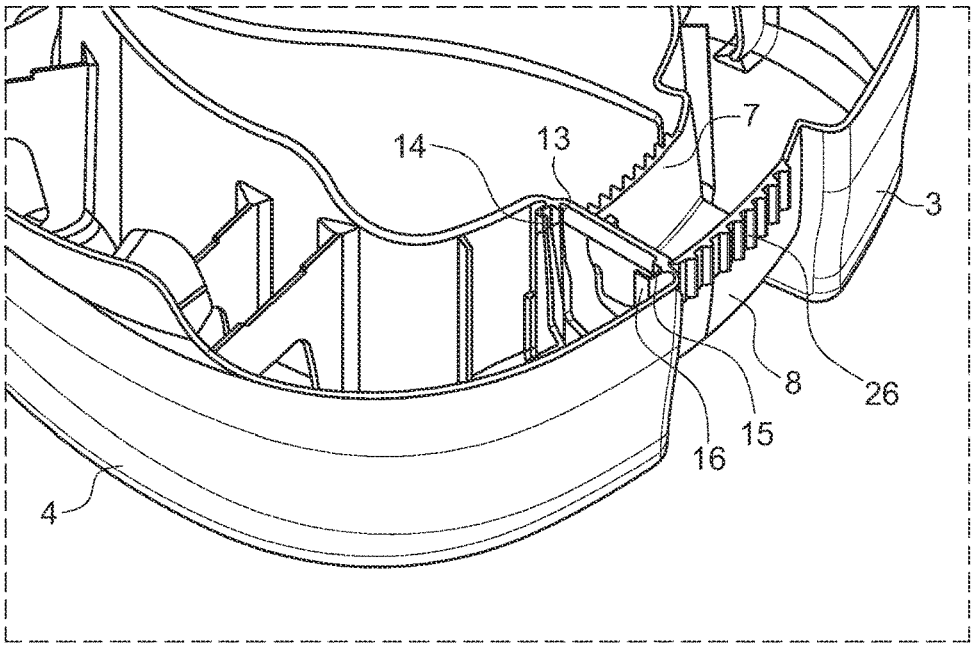
FIG. 4 depicts a partial perspective view, from beneath, of the attachment channel section of the raised seat prior to fitting.
Figure 5:
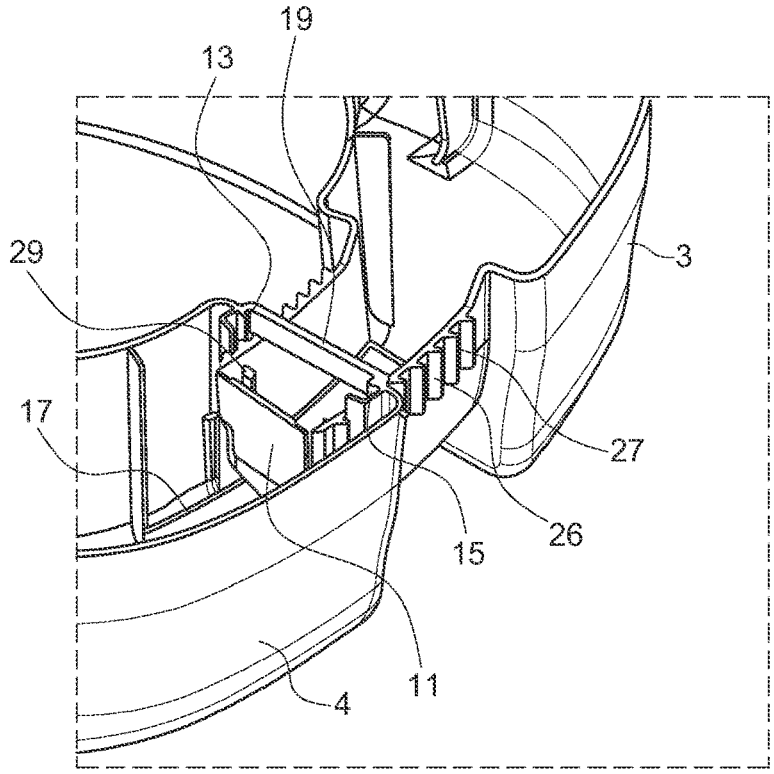
FIG. 5 depicts a partial perspective view, from beneath, of the attachment channel section after initial insertion of the channel section.
Figure 6:
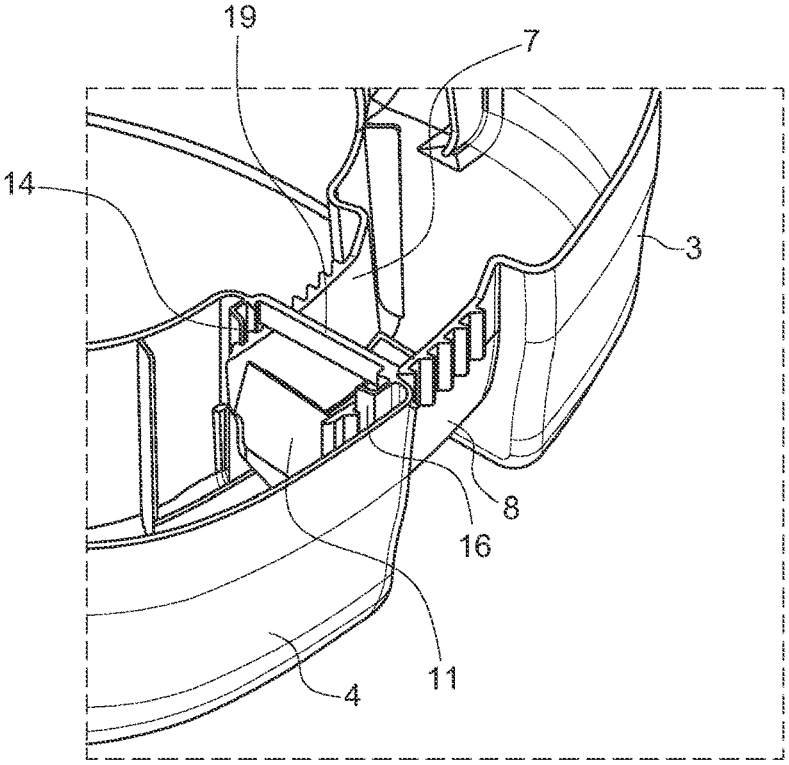
FIG. 6 depicts a partial perspective view, from beneath, of the attachment channel section of the raised seat after the side walls of the channel section have been locked in relative position by the flap.

The invention relates to a raised seat 1 made of moulded plastic, intended to be placed and fixed on a toilet bowl, of oval overall shape, and having, prior to fitting, a gap at its rear part. The raised seat 1 has a front part 2 and, between this front part 2 and the gap at the back, two mutually symmetrical arc-shaped wings 3, 4.

The first 3 of these wings bears, at its free end, a channel section 5 made up of a flat bottom 6 at the top, and of two side walls 7, 8.

The flat bottom 6 of the channel section 5 bears, on its top face, a visible mark 28.

The side walls 7, 8 are parallel to one another and substantially perpendicular to the flat bottom 6. The side walls 7, 8 and the flat bottom 6 have substantially the same width, which means that in cross section the channel section 5 is substantially square. Each of the side walls 7, 8 bears, in the vicinity of its free end, and on its exterior face, a series of regularly spaced notches 9, 10. The side walls 7, 8 and the flat bottom 6 have a certain elasticity and the free edges of the side walls 7, 8 can be brought closer together by manual pressure.

Articulated to the free edge situated at the end of the flat bottom 6 is a substantially square flap 11 able to be lodged between the side walls 7, 8 in order to lock them in position parallel to one another, thereby preventing them from moving closer together so as to prevent accidental opening of the raised seat and keep it in position. Advantageously, the side walls 7, 8 each bear, on their interior face, an end stop 29 against which the flap 11 can bear. In this position, bearing against the end stops 29, the flap 11 acts as a lock. The flap 11 can also be pivoted towards the outside of the channel section 5 and leave the side walls 7, 8 free to be brought closer together manually.

The second 4 of the wings of the raised seat ends in an opening 12 of substantially square shape, able to accept the channel section 5. Behind this opening 12, the wing 4 has, on each side, two lateral ridges 13, 14; 15, 16 spaced by the same spacing as the notches 9, 10 of the channel section 5, and, in its central part, ribs 17, 18 on which the flat bottom 6 can bear. The opening 12 comprises a crosspiece 19 for guiding the free end of the side walls 7, 8 of the channel section 5.

The raised seat 1 comprises, to hold it stably on the toilet bowl, lips to press against the exterior lateral surface of the toilet bowl: a front lip 20 to press laterally against the front part of the bowl, and two lateral lips 21, 22 to press laterally against the sides of the bowl.

The raised seat 1 has a hollow structure comprising partition walls to bear against the toilet bowl, the partition walls being arranged symmetrically beneath the two wings 3, 4 of the raised seat, towards the front 23 and under the widest bit towards the back 24, 25.

The raised seat 1 is moulded in a single piece.

The raised seat 1 is fitted to a toilet bowl in a simple manner.

First of all, the flap 11 is pivoted towards the outside of the channel section 5 and the channel section 5 is inserted into the opening 10 as far as the visible mark 28. The flap 20 is then pivoted back towards the inside of the channel section 5 to lock the side walls 7, 8 of the channel section 5 in their relative position. The raised seat 1 is placed on the bowl, with its front lip 20 pressing against the front lateral part of the bowl. The wings 3, 4, which are separated from one another at the gap at the back of the raised seat overhang the bowl at the sides.

The wings 3, 4 are then pushed together manually. The lateral pressure applied to the wings 3, 4 causes the channel section 5 to progress further into the opening 12 until the lateral lips 21, 22 come to press laterally against the sides of the bowl. During this progression, the notches 9, 10 borne by the side walls 7, 8 of the channel section 5 pass over the ridges 13, 14, 15, 16, squeezing the side walls 7, 8 closer together each time a ridge is overcome. To facilitate this passage, the notches 9, 10 have a front face 26 that is oblique, and in order to keep them in position after they have overcome the ridges, the notches have a rear face 27 that is substantially perpendicular to the respective wall 7, 8. During this progression, the entire structure of the raised seat deforms elastically. At the end of the progression, the raised seat is in a stable position on the bowl, held by the front lip 20 and lateral lips 21, 22 pressing against the sides of the bowl.

The raised seat is removed from the bowl by pulling vertically. After the raised seat has been turned over, the flap 11 is pivoted manually out of the channel section 5, then the two side walls 7, 8 are grasped manually close to their free end and moved closer together to cause the notches 9, 10 to escape from the ridges 13, 14, 15, 16. The elasticity of the raised seat allows the ends of the wings 3, 4 to spring apart and a gap to be created at the back of the raised seat.

Assembling the raised seat by simply clipping the notches 9, 10 over the ridges 13, 14, 15, 16 allows the raised seat to be adapted to suit the dimensions of the bowl. The elasticity of the structure of the raised seat on the one hand allows it to adapt to suit the bowl and on the other hand makes it easy to remove, particularly for the purposes of cleaning it.

The invention claimed is:

1. A raised toilet seat comprising:

a front part; and first and second wings, connected at said front part and having first and second opposite ends respectively that are separated by a gap before the first and second ends of said two wings are fitted together, the first wing has at said first free end a channel section equipped with notches, and, said second wing has at said second free end an opening to accept the channel section, and ridges to retain the notches, wherein the channel section is formed of a flat bottom and opposing side walls that are parallel to one another, said side walls bearing the notches on free bottom edges of exterior faces thereof, and wherein the channel section has a flap able to be lodged between the opposing side walls in order to lock them in position parallel to one another, said flap dimensioned at a free end of said channel section between said opposing side walls and said flat bottom.

2. The raised seat according to claim 1, wherein the raised seat further comprises a front lip and two lateral lips for pressing laterally on the front part and on sides of a toilet bowl respectively.

3. The raised seat according to claim 1, wherein the notches have an oblique front face configured to pass over the ridges, and a rear face that is substantially perpendicular to a respective side wall so that they are retained by the ridges.

4. A method for fitting the raised seat according to claim 1, said method including the steps of:

pivoting the flap towards an outside of the channel section;

inserting the channel section, borne by said first wing of the raised seat into the opening borne by the second wing of the raised seat to a depth set by a visible mark;

pivoting the flap towards an inside of the channel section to lock the opposing side walls of the channel section in their relative parallel position;

placing the raised seat onto the toilet bowl with the front lip pressing against a front lateral part of the toilet bowl;

using manual pressure to bring the first and second wings of the raised seat closer together, causing the channel section to progress further in the opening and causing the notches to move past the ridges until the lateral lips are pressing against the sides of the toilet bowl.

5. A method for removing the raised seat as fitted according to claim 4, said method further comprising the steps of:

removing the raised seat from the bowl by pulling vertically;

turning the raised seat over;

pivoting the flap towards the outside of the channel section;

grasping the opposing side walls of the channel section between the first and second wings of the raised seat and bringing them closer towards one another causing the notches to escape from the ridges;

allowing elasticity of the raised seat to spring apart the first and second free ends of the first and second wings.

* * * * *